US012678699B2

(12) United States Patent
Kamiyama

(10) Patent No.: US 12,678,699 B2
(45) Date of Patent: Jul. 14, 2026

(54) FIGURE-PLAYABLE PORTABLE TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 176 days.

(21) Appl. No.: 18/413,808

(22) Filed: Jan. 16, 2024

(65) Prior Publication Data

US 2024/0238684 A1 Jul. 18, 2024

(30) Foreign Application Priority Data

Jan. 17, 2023 (JP) ..... 2023-005144

(51) Int. Cl.
*A63H 3/52* (2022.01)

(52) U.S. Cl.
CPC ..... *A63H 3/52* (2013.01)

(58) Field of Classification Search
CPC ..... A63H 3/52; A63H 33/003; A63H 33/008; A63H 33/42
See application file for complete search history.

(56) References Cited

U.S. PATENT DOCUMENTS 2,511,211 A * 6/1950 Klein ..... B65D 5/4258 206/45.28
3,042,192 A * 7/1962 Herrin ..... A45C 11/16 220/843
4,397,387 A * 8/1983 Bidegain ..... B65D 43/164 206/45.23
5,152,710 A * 10/1992 Montgomery ..... A63H 3/52 220/4.23
5,830,033 A * 11/1998 Piron ..... A63H 33/42 206/45.28
7,594,844 B2 * 9/2009 Cartlidge ..... A63H 33/38 446/478
7,618,301 B2 * 11/2009 Knight ..... A63H 33/42 446/478
7,733,753 B2 * 6/2010 Mizuno ..... G11B 7/0953 369/53.28
8,251,224 B2 * 8/2012 Meger ..... B65D 81/368 206/769
8,328,596 B2 * 12/2012 Payne ..... A63H 33/42 446/72
11,426,666 B2 * 8/2022 Glasenhardt ..... A63H 33/003
2006/0099874 A1 * 5/2006 Cartlidge ..... A63H 33/42 446/82
2008/0014828 A1 * 1/2008 Kelly ..... A63H 3/50 446/73

FOREIGN PATENT DOCUMENTS

JP 5314212 B1 10/2013

* cited by examiner

*Primary Examiner* — John A Ricci
(74) *Attorney, Agent, or Firm* — Faegre Drinker Biddle & Reath LLP

(57) ABSTRACT

A figure-playable portable toy includes: a body configured to be installed on an installation surface; a lid provided on the body via a first hinge so as to be allowed to open and close, the lid defining a storage space between the lid and the body; and a grip portion. The lid includes a contact portion that comes into contact with the installation surface in a state in which the lid is opened relative to the body such that the contact portion holds the lid while the lid is erected relative to the installation surface.

6 Claims, 9 Drawing Sheets

FIGURE-PLAYABLE PORTABLE TOY

CROSS-REFERENCE TO RELATED APPLICATIONS

This application is based on and claims priority under 35 USC 119 from Japanese Patent Application No. 2023-005144 filed on Jan. 17, 2023, the contents of which are incorporated herein by reference.

TECHNICAL FIELD

The present disclosure relates to a figure-playable portable toy.

BACKGROUND ART

A figure-playable portable toy is known in the related art, in which the toy for figure play is stored inside an openable and closable case and can be carried. For example, JP5314212B discloses a house toy including an upper case that is a lid, a lower case that is a body, and a hinge that pivotably connects the upper case and the lower case, which stores miniatures or the like that imitate furniture in an internal space surrounded by the lower case and the upper case. The lower case is provided with a through hole through which a portable strap is inserted, so that the house toy is portable.

SUMMARY OF INVENTION

In the figure-playable portable toy, it may be desired to play in a form of simulating a store by erecting a lid on an installation surface in a state in which the lid is opened. However, in the house toy of JP5314212B, the upper case is opened at an angle of substantially 180 degrees relative to the lower case installed on an installation surface in a state in which the upper case is opened, and the upper case cannot be stably erected relative to the installation surface.

An object of the present disclosure is to provide a figure-playable portable toy including a lid that can be stably erected relative to an installation surface.

In an aspect of the present disclosure, there is provided a figure-playable portable toy including: a body configured to be installed on an installation surface; a lid provided on the body via a first hinge so as to be allowed to open and close, the lid defining a storage space between the lid and the body; and a grip portion, in which the lid includes a contact portion that comes into contact with the installation surface in a state in which the lid is opened relative to the body such that the contact portion holds the lid while the lid is erected relative to the installation surface.

According to an aspect of the present disclosure, it is possible to provide a figure-playable portable toy including a lid that can be stably erected relative to an installation surface.

BRIEF DESCRIPTION OF DRAWINGS

The present disclosure will be described in detail based on the following without being limited thereto, wherein.

DESCRIPTION OF EMBODIMENTS

Figure 1:
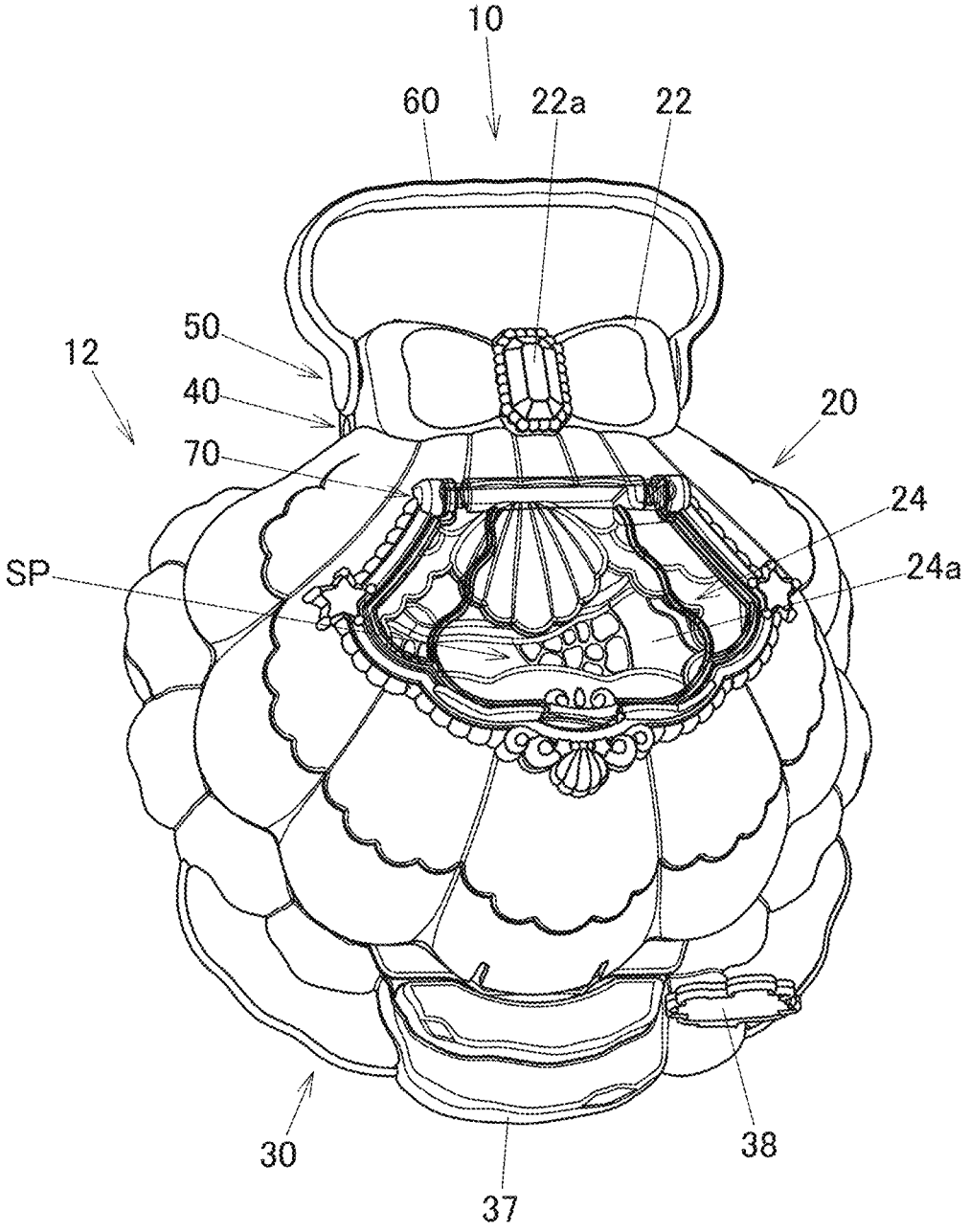
FIG. 1 is an overall perspective view of a portable toy according to an embodiment of the present disclosure when viewed from an upper side in a state in which a lid is closed.
Figure 2:
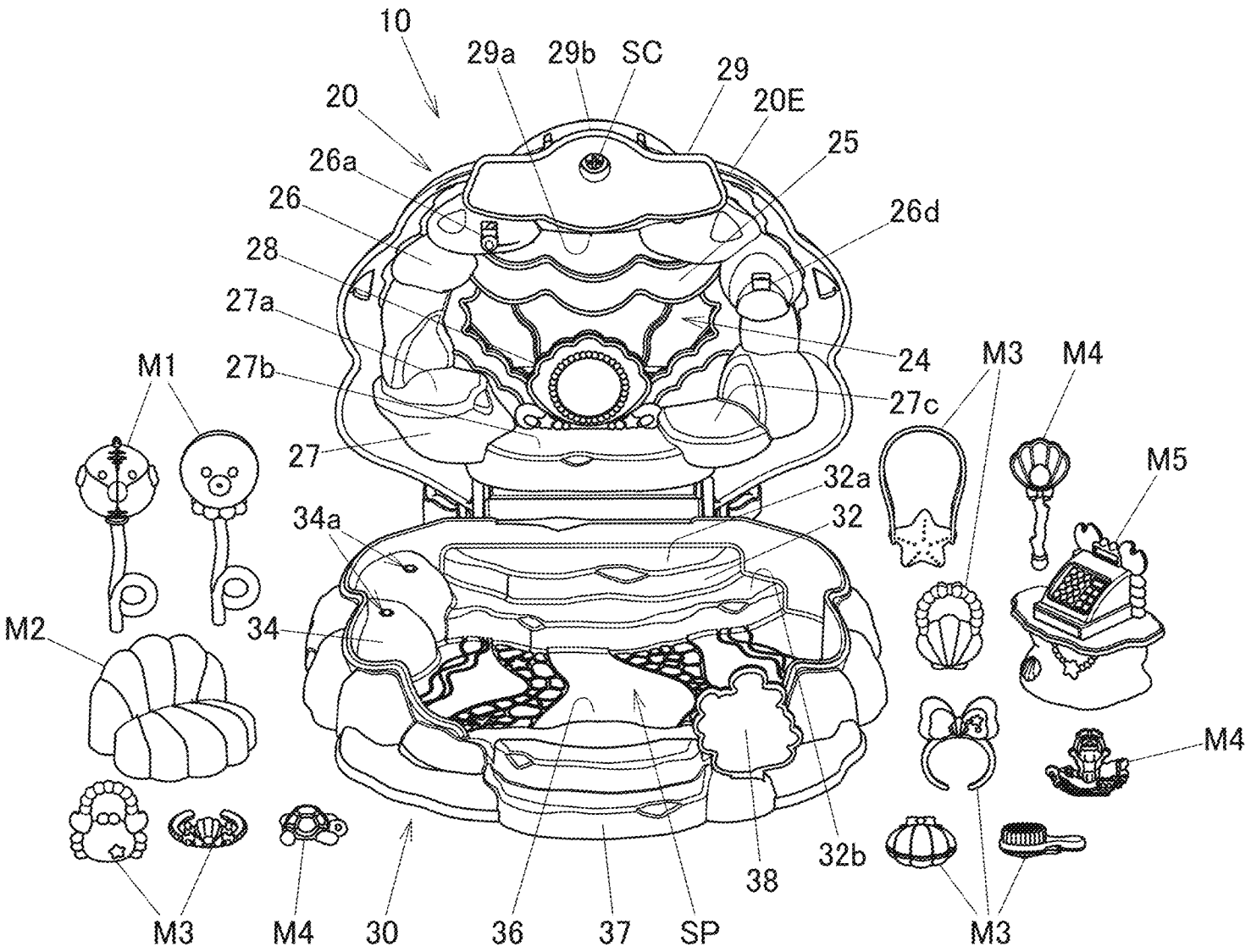
FIG. 2 is an overall perspective view of the portable toy according to the embodiment of the present disclosure when viewed from a front side in a state in which the lid is opened.

An embodiment of the present disclosure will be described with reference to the drawings. As shown in FIG. 1, a figure-playable portable toy (hereinafter referred to as "portable toy 10") according to the embodiment includes a case 12 that is made of a resin material and has a shell shape as a whole. The case 12 includes a lid 20 and a body 30. The lid 20 is openable and closable relative to the body 30 via a first hinge 40 (a state in which the lid 20 is opened is shown in FIG. 2). In the following description, a side on which the first hinge 40 is provided is referred to as a rear side of the portable toy 10, an opposite side thereof is referred to as a front side, left and right sides when the portable toy 10 is viewed from the front side are referred to as a left side and a right side of the portable toy 10, respectively, a lid 20 side is referred to as an upper side of the portable toy 10, and a body 30 side is referred to as a lower side.

Figure 7:
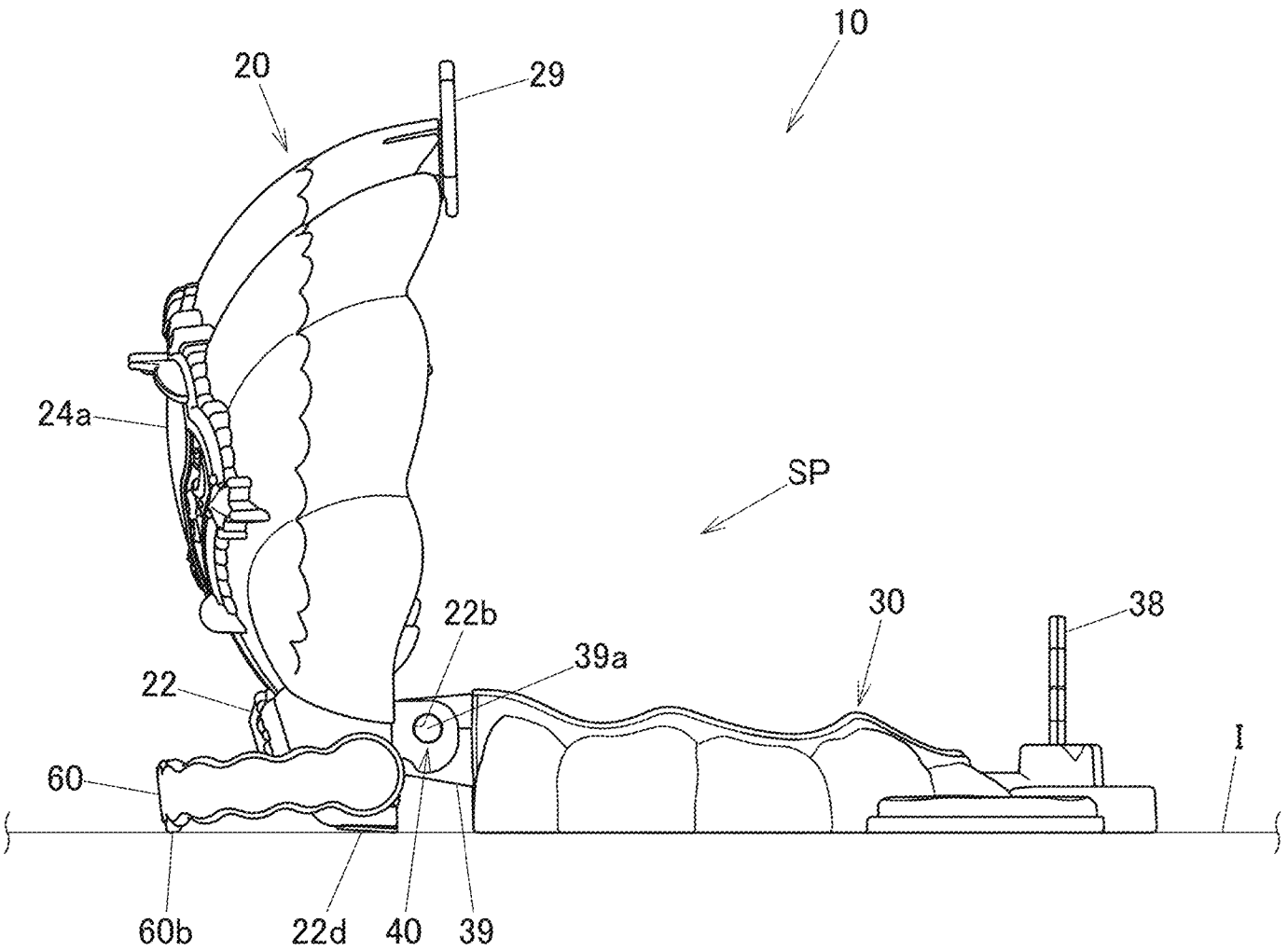
FIG. 7 is a left side view of the portable toy according to the embodiment of the present disclosure in a state in which the lid is opened.

The portable toy 10 includes a handle-shaped grip portion 60 that is slightly rearward of the first hinge 40 and is pivotable relative to the lid 20 via a second hinge 50. As shown in FIG. 2, the case 12 has a hollow inside, which is a storage space SP that stores a figure D (see FIG. 4) and model toys M1 to M5. As shown in FIG. 7, in the portable toy 10 in a state in which the lid 20 is opened, the lid 20 can be held in a state of being erected at substantially 90 degrees relative to an installation surface I.

The portable toy 10 likens the storage space SP to a store and enables figure play using the figure D and the model toys M1 to M5 in a state in which the lid 20 is opened (hereinafter, referred to as an "opened state"), and can be easily carried by gripping the grip portion 60 in a state in which the lid 20 is closed (hereinafter, referred to as a "closed state"). Hereinafter, the portable toy 10 will be described in detail.

As shown in FIG. 1, the lid 20 is provided with, at a rear end portion, a decorative portion (pivot base portion) 22 that imitates a ribbon. The decorative portion 22 is provided with, at a center, a gemstone portion 22*a* that imitates a gemstone. The decorative portion 22 is further provided with the first hinge 40 and the second hinge 50. The lid 20 is provided with, substantially at a center, a small window 24 that has a shell shape and opens. The small window 24 is provided with, at a rear end portion, a transparent window lid 24*a* that is openable and closable relative to the small window 24 via a third hinge 70. In the closed state of the portable toy 10, the storage space SP can be visually recognized through the small window 24.

Figure 4:
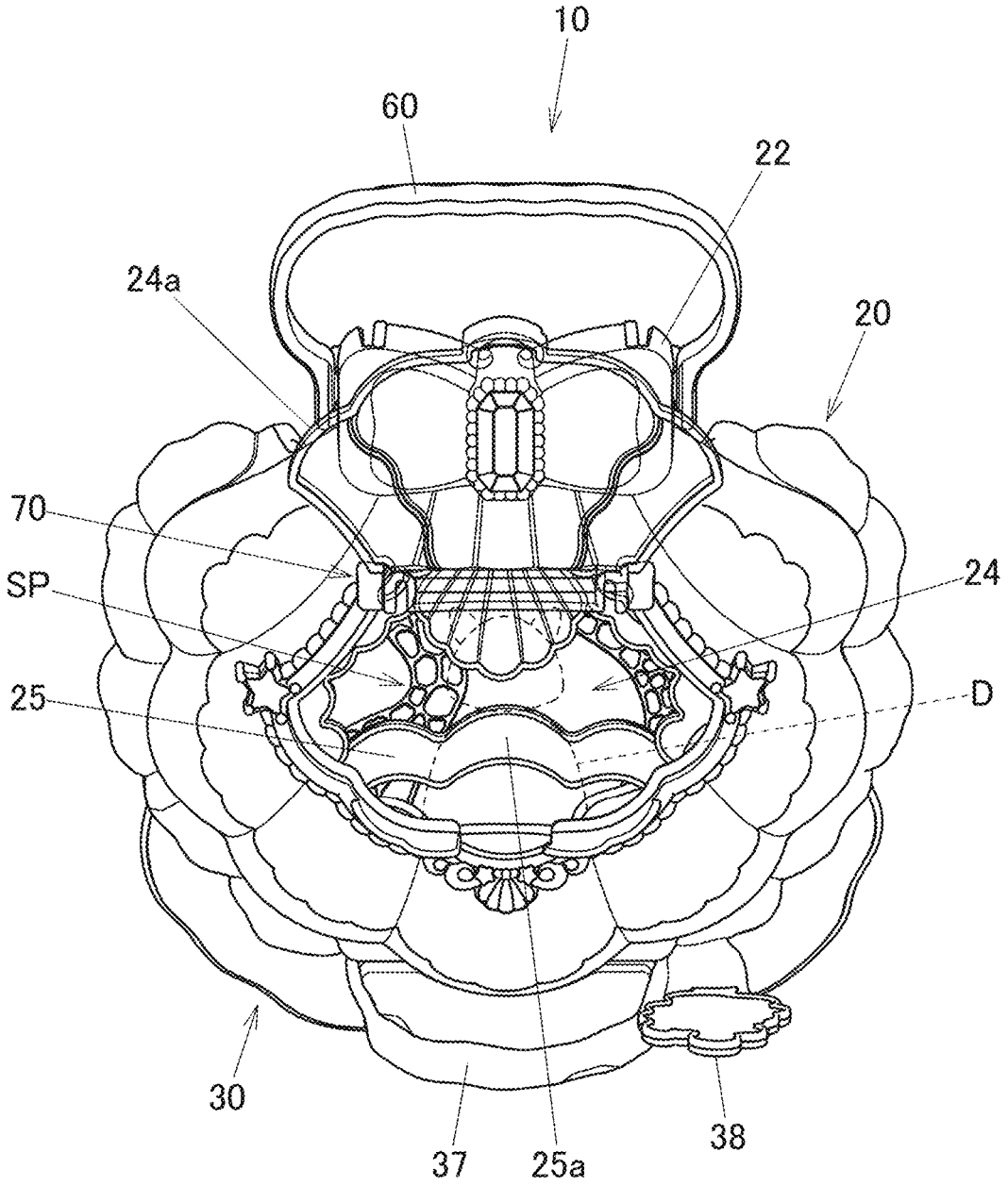
FIG. 4 is an overall perspective view of the portable toy according to the embodiment of the present disclosure when viewed from the upper side in a state in which a window lid is opened.

As shown in FIGS. 2 and 4, in a vicinity of the small window 24 in the storage space SP, a holding portion 25 is provided to hold the figure D. The holding portion 25 bridges a right side and a left side in the vicinity of the small window 24 on an inner surface side of the lid 20, and a central portion thereof is a recess portion 25*a* that is a concave arc-shaped curved surface directed at the lower side (side opposite to a small window 24 side). By attaching a back surface of the small figure D to the recess portion 25*a*, the figure D can be held in an upright state inside the small window 24. For this reason, when the portable toy 10 is carried in the closed state, the figure D can be exposed to the outside through the small window 24.

Figure 3:
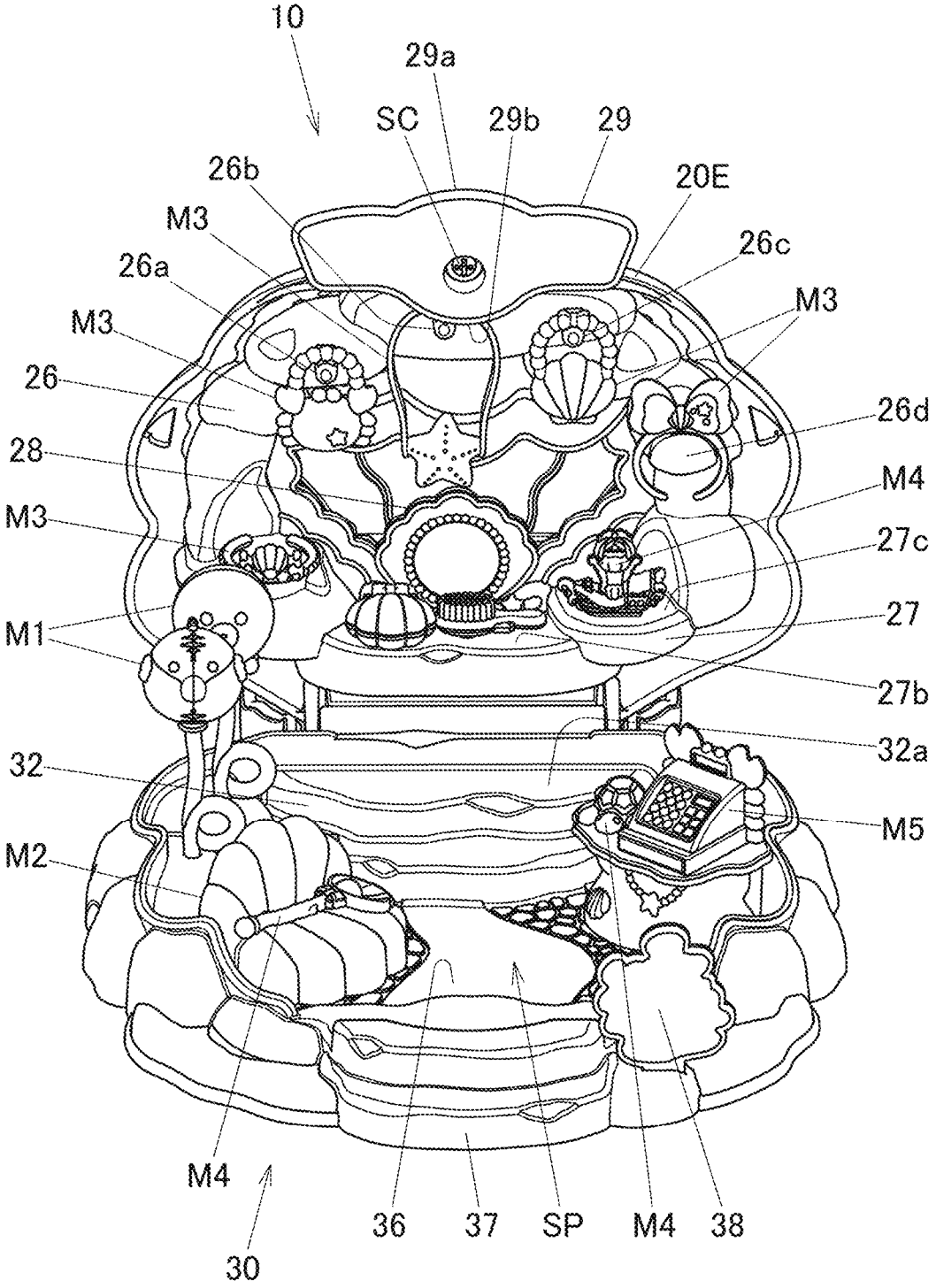
FIG. 3 is an overall perspective view of the portable toy according to the embodiment of the present disclosure when viewed from the front side in a state in which the lid is opened.

As shown in FIGS. 2 and 3, the lid 20 has a deep dish shape opened in a substantially circular shape on the inner surface side, and is provided with a first display portion 26 and a second display portion 27 where the model toys M1 to M5 are attached or placed for display. The first display portion 26 bulges inward from a front portion on the inner surface side of the lid 20, and is provided with, on a surface thereof, a plurality of hook portions 26*a* to 26*d* to attach the model toys M3. The second display portion 27 bulges in a step shape from a rear portion on the inner surface side of the lid 20, and is provided with, on a surface thereof, a plurality of lid-side placement surfaces 27*a* to 27*c* to place the model toys M1 to M5. The lid-side placement surface 27*b* at a center is provided with, on a deep side, a substantially circular mirror portion 28 that simulates a mirror.

A first signboard (plate-shaped member) 29 is attached, via an attachment screw SC, to a front end portion on the inner surface side of the lid 20. The first signboard 29 has a substantial plate shape horizontally elongated in a left-right direction, and two board surfaces thereof are directed at a front-rear direction in the opened state. The first signboard 29 is rotatable about a screw axis of the attachment screw SC, and by rotating the first signboard 29 by 180 degrees, the first signboard 29 can be switched between a stored state (see FIG. 2) in which one end side 29*a* in an upper-lower direction is stored inward of an outer edge 20E of the lid 20 and a protruding state (see FIG. 3) in which the one end side 29*a* protrudes outward of the outer edge 20E of the lid 20. In the stored state, the other end side 29*b* of the first signboard 29 in the upper-lower direction protrudes slightly outward (upward) of the outer edge 20E of the lid 20.

On the other hand, as shown in FIGS. 2 and 3, the body 30 has a deep dish shape opened in a substantially circular shape on an inner surface side, and is provided with a rear staircase portion 32, a third display portion 34 where the model toys M1 to M5 are attached or placed for display, and a floor portion 36. The rear staircase portion 32 is provided in a staircase shape at a rear portion on the inner surface side of the body 30, and imitates a staircase for the figure D. Surfaces of the rear staircase portion 32 include staircase surfaces 32*a* and 32*b*. The third display portion 34 bulges inward from a left side portion on the inner surface side of the body 30, and is provided with, on a surface thereof, two attachment holes 34*a* to attach the model toys M1.

The floor portion 36 is provided on the inner surface side of the body 30 excluding the rear staircase portion 32 and the third display portion 34, and is a flat surface imitating a floor of the store. The body 30 is provided with, substantially at a center of a front end portion thereof, a front staircase portion 37 having a staircase shape extending from a front side of the body 30 to the floor portion 36. The front staircase portion 37 is provided with a plate-shaped second signboard 38 on a right side. The second signboard 38 imitates a standing signboard, and two board surfaces thereof are directed in the front-rear direction.

The model toys M1 to M5 displayed on the inner surface sides of the lid 20 and the body 30 include the balloon model toys M1 imitating fugu and octopus balloons, the chair model toy M2 imitating a shell-shaped chair, the model toys M3 imitating products such as handbags and hair accessories decorated with crabs, shells, and the like, the model toys M4 imitating ornaments such as turtles and shells, and the model toy M5 imitating a cash register decorated with crabs and a table on which the cash register is placed. In this manner, the model toys M1 to M5 are model toys that imitate creatures in the sea.

As shown in FIG. 3, the balloon model toys M1 are attached to the attachment holes 34*a* of the third display portion 34, the chair model toy M2 is disposed, for example, on a left side of the floor portion 36, the model toys M3 imitating products and the model toys M4 imitating ornaments are attached to or placed on, for example, the first to third display portions 26, 27, and 34 for display, and the model toy M5 imitating a cash register and a table is disposed, for example, on the right side of the floor portion. Further, for example, a sticker on which a logo of a store name is described can be attached to the first signboard 29 and the second signboard 38. In this manner, a user playing with the portable toy 10 in the opened state can enjoy an impression that the entire portable toy 10 is a store opened in the sea.

Figure 5:
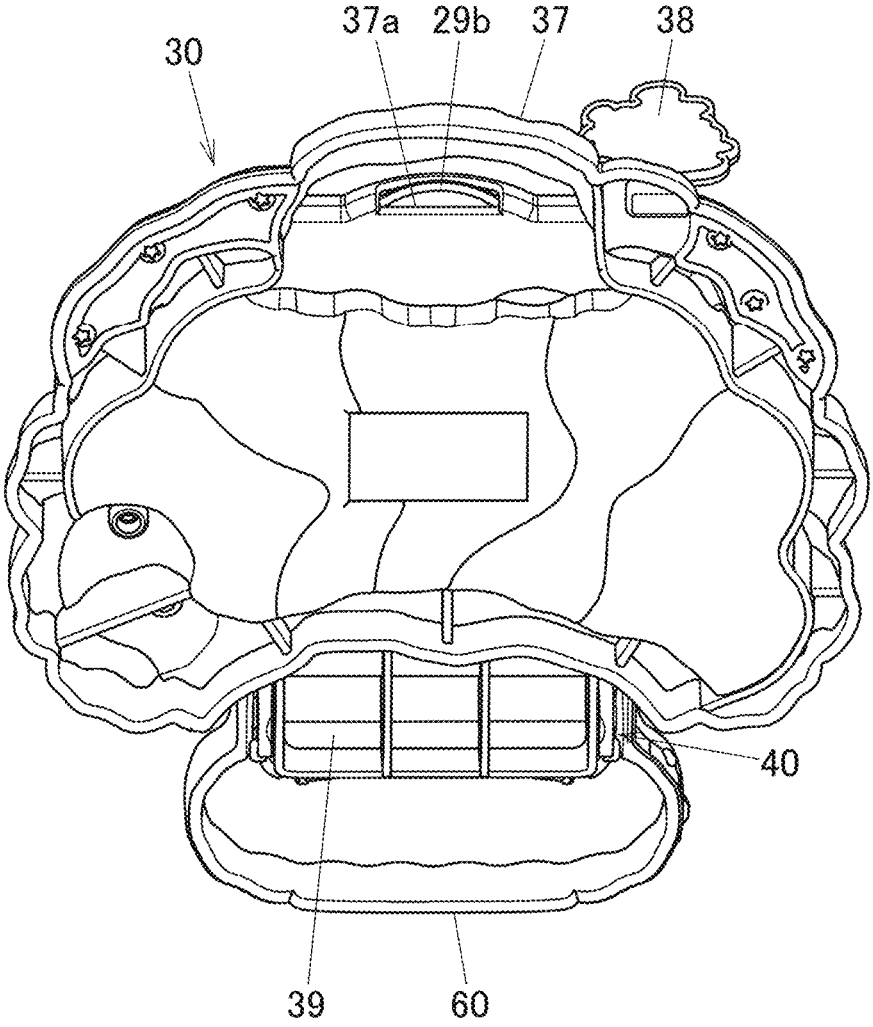
FIG. 5 is a perspective view of the portable toy according to the embodiment of the present disclosure when viewed from a lower side.

Here, an engagement structure between the lid 20 and the body 30 will be described. As shown in FIG. 5, the front staircase portion 37 is provided with, on a back side (lower side), an engagement hole (engagement portion) 37*a* having a horizontally elongated rectangular shape and communicating between inside and outside of the storage space SP. The engagement hole 37*a* has a size for a top end portion of the other end side 29*b* of the first signboard 29 to be fitted. When the portable toy 10 is changed from the opened state to the closed state, the first signboard 29 is changed from a protruding state to a stored state, the lid 20 is closed, and the top end portion of the other end side 29*b* of the first signboard 29 is fitted into the engagement hole 37*a* while and the front staircase portion 37 is elastically deformed. Accordingly, the first signboard 29 is engaged with the engagement hole 37*a*, and the lid 20 can be locked to the body 30 in the closed state.

Next, configurations of the first hinge 40 and the second hinge 50, which are main portions of the present disclosure, and pivot modes thereof will be described. As shown in FIG. 5, a connection portion 39 having a substantially rectangular plate shape and a large thickness is provided at a rear end portion of the body 30. The connection portion 39 is provided with the first hinge 40. That is, the first hinge 40 pivotably connects the decorative portion 22 of the lid 20 and the connection portion 39 of the body 30.

Figure 6:
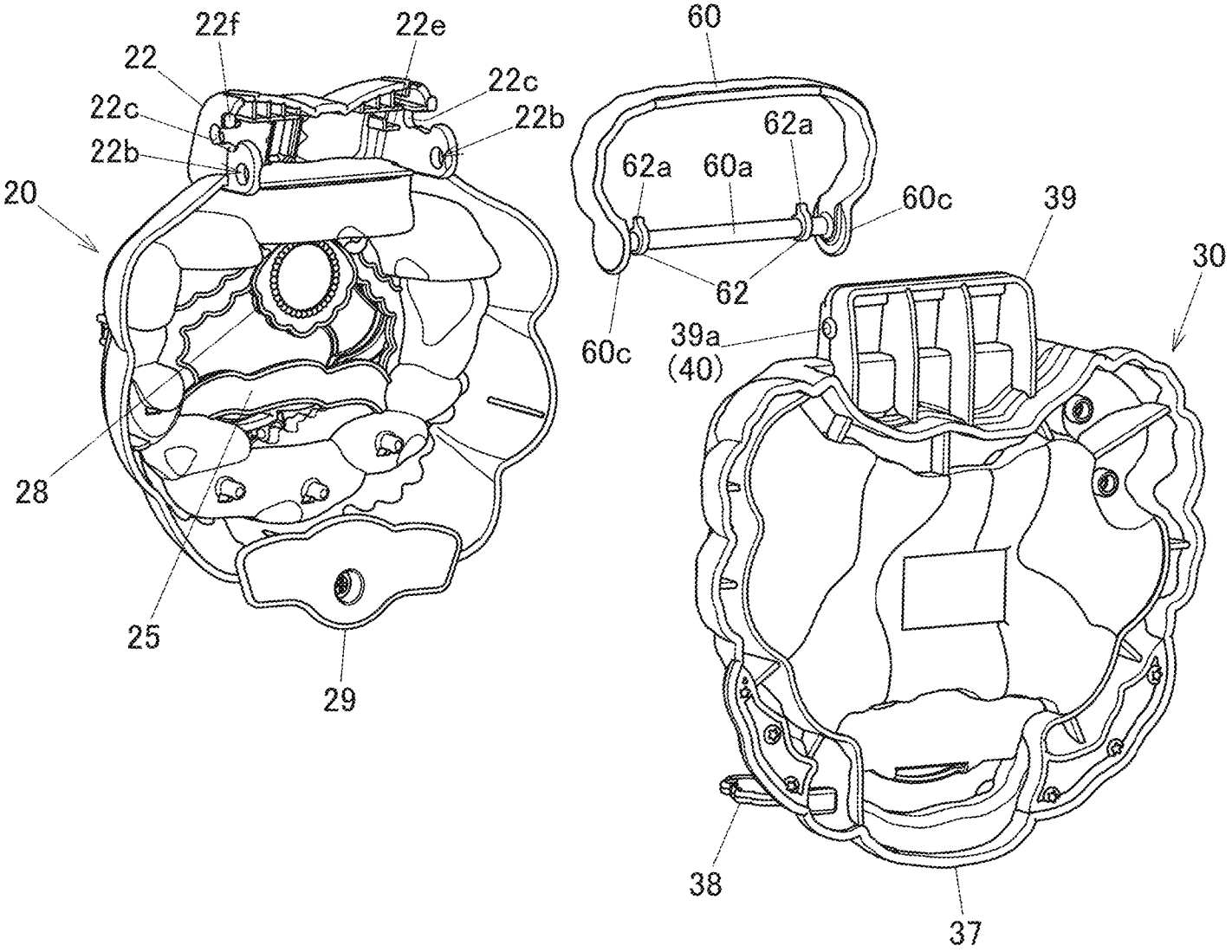
FIG. 6 is an exploded perspective view of the portable toy according to the embodiment of the present disclosure when viewed obliquely from the lower side.

As shown in FIG. 6, the connection portion 39 is provided with, on each of left and right side surfaces, a first hinge shaft 39*a* that is a hinge shaft of the first hinge 40. The first hinge shaft 39*a* has an axial direction thereof coinciding with the left-right direction, and protrudes from each of the left and right side surfaces of the connection portion 39. On the other hand, the decorative portion 22 is provided with, in front portions on an inner side (lower side in the closed state), a pair of first shaft holes 22*b* into which two end portions of the respective first hinge shafts 39*a* are pivotably fitted. The first hinge 40 is implemented by fitting the two end portions of the respective first hinge shafts 39*a* into the respective first shaft holes 22*b*, and the lid 20 and the body 30 are connected to be openable and closable.

The first hinge shafts 39*a* slightly protrude from the connection portion 39, and are loosely fitted to the first shaft holes 22*b*. For this reason, even when the user who plays with the portable toy 10 has a finger or the like temporarily sandwiched between the lid 20 and the body 30 when the portable toy 10 is changed from the opened state to the closed state, the lid 20 is easily detached from the body 30. Further, portions where the lid 20 and the body 30 mesh with each other in the closed state are not sharp but smooth and flat. With such a configuration, when the user has a finger or the like sandwiched between the lid 20 and the body 30, the finger or the like is prevented from damage and safety is ensured.

The grip portion 60 is provided with, on a base end side of a handle thereof, a second hinge shaft 60*a* that is a hinge shaft of the second hinge 50. The second hinge shaft 60*a* has an axial direction thereof coinciding with the left-right direction. That is, the second hinge shaft 60*a* of the second hinge 50 is parallel to the first hinge shaft 39*a* of the first hinge 40. On the other hand, the decorative portion 22 is provided with, in rear portions on the inner side, a pair of second shaft holes 22*c* into which two end portions of the second hinge shaft 60*a* are pivotably fitted.

The second shaft hole 22*c* has a cutout shape opened downward, and a portion into which the second hinge shaft 60*a* is fitted has a substantial arc shape along an outer peripheral surface of the second hinge shaft 60*a*. For this reason, the second hinge shaft 60*a* is freely fitted into the second shaft holes 22*c* from below. The second hinge 50 is implemented by freely fitting two end portions of the second hinge shaft 60*a* into the respective second shaft holes 22*c* each having a cutout shape, and the grip portion 60 is pivotably connected to the lid 20. The grip portion 60 in which the second hinge shaft 60*a* is freely fitted into the second shaft holes 22*c* can be easily detached from the lid 20.

As shown in FIG. 7, in the portable toy 10, when the body 30 is installed on the installation surface I and the lid 20 is opened in a state of being erected at substantially 90 degrees relative to the installation surface I, a part of a rear end portion of the decorative portion 22 comes into contact with the installation surface I (hereinafter, the part of the decorative portion 22 that comes into contact with the installation surface I is referred to as a "first contact portion (contact portion) 22*d*"). As shown in FIG. 4 or the like, the rear end portion of the decorative portion 22 is a portion having a thickness in the upper-lower direction, and thus the first contact portion 22*d* comes into surface contact with the installation surface I. For this reason, in the opened state, the lid 20 can be stably held in an erected state relative to the installation surface I.

Figure 8:
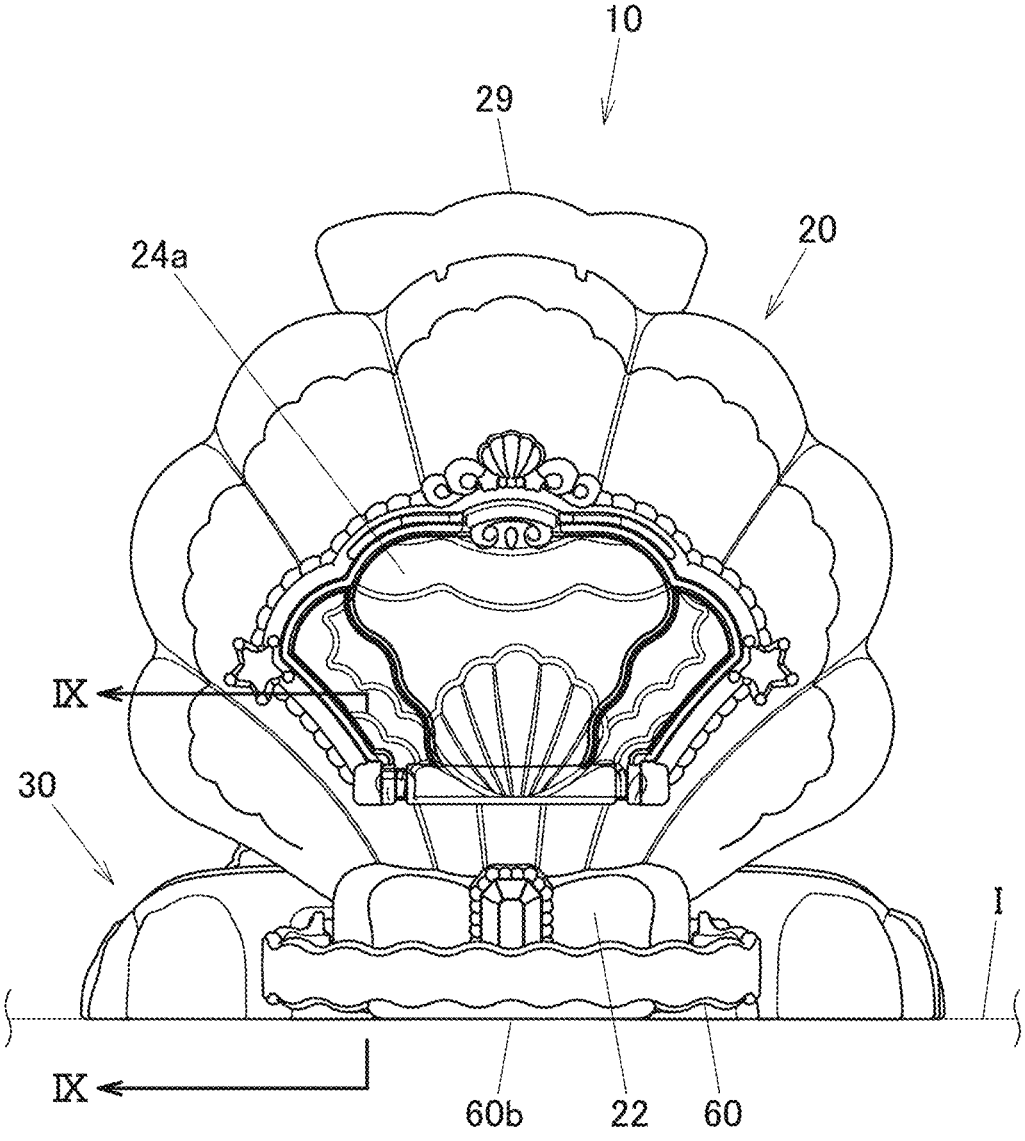
FIG. 8 is a rear view of the portable toy according to the embodiment of the present disclosure in a state in which the lid is opened.

As shown in FIGS. 7 and 8, when the grip portion 60 is pivoted downward in the state in which the lid 20 is erected relative to the installation surface I, a part of a rear end portion of the grip portion 60 comes into contact with the installation surface I (hereinafter, the part of the grip portion 60 that comes into contact with the installation surface I is referred to as a "second contact portion 60*b*"). In other words, the grip portion 60 is pivotable until the second contact portion 60*b* comes into contact with the installation surface I in a state in which the body 30 is installed on the installation surface I. The second contact portion 60*b* extends in the left-right direction. For this reason, the portable toy 10 can be effectively prevented from falling down to the rear side in the state in which the lid 20 is erected relative to the installation surface I.

As shown in FIG. 6, minute protrusions 22*f* slightly protruding outward from an outer surface of the decorative portion 22 are provided rearward of the second shaft holes 22*c*. For this reason, when the grip portion 60 pivots rearward to approach the rear end portion of the body 30 in the closed state, outer edges 60*c* located at two end portions of the second hinge shaft 60*a* of the grip portion 60 interfere with the minute protrusions 22*f* and climb over the minute protrusions 22*f*, and excessive rearward pivot of the grip portion 60 is prevented. Accordingly, since the grip portion 60 is pivoted until the grip portion 60 comes into contact with the rear end portion of the body 30 when the lid 20 shifts from the closed state to the opened state, the grip portion 60 can be avoided from interfering with opening of the lid 20.

As shown in FIG. 6, an annular portion 62 having a larger diameter than the second hinge shaft 60*a* is provided about the second hinge shaft 60*a* on each of right and left sides. The annular portion 62 is provided with a protruding portion 62*a* radially protruding in a protruding shape from a part of an outer peripheral surface thereof. The protruding portions 62*a* of the annular portions 62 protrude in the same direction. On the other hand, a rib-shaped portion 22*e* protruding in a rib shape to the lower side (body 30 side) is provided in a vicinity of each second shaft hole 22*c* on the inner surface side of the decorative portion 22.

Figure 9:
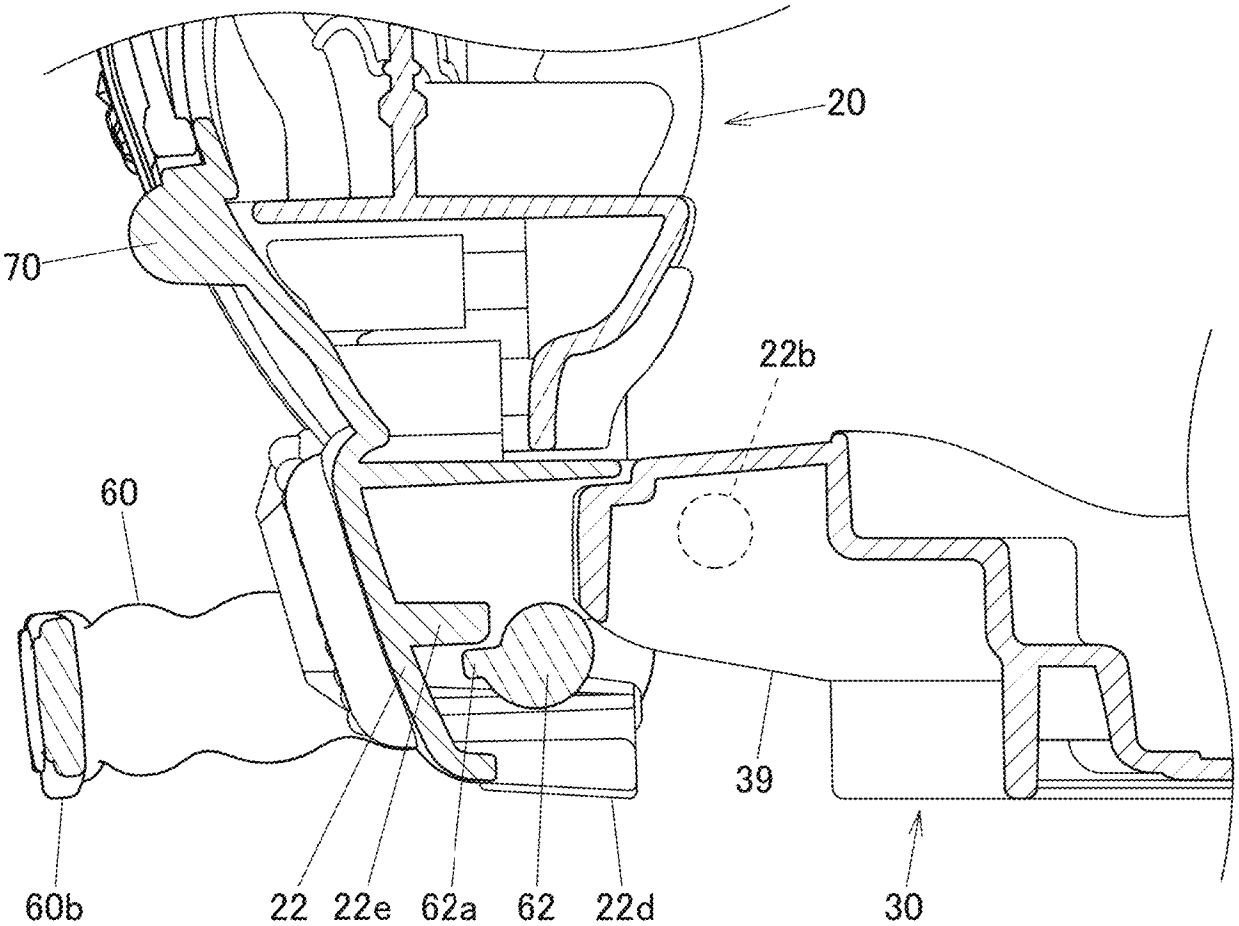
FIG. 9 is a cross-sectional view of a second hinge of the portable toy according to the embodiment of the present disclosure, which is a cross-sectional view taken along a line IX-IX in FIG. 8.

When the second hinge shaft 60*a* is freely fitted into the second shaft holes 22*c*, positions of the protruding portions 62*a* in the left-right direction substantially coincide with positions of the rib-shaped portion 22*e* in the left-right direction. In the state in which the body 30 is installed on the installation surface I and the lid 20 is erected (state shown in FIGS. 7 and 8), as shown in FIG. 9, the protruding portions 62*a* approach the rib-shaped portions 22*e* on lower sides of the rib-shaped portions 22*e*. For this reason, when the lid 20 is further pivoted in an opening direction from this state, the rib-shaped portions 22*e* interfere with the protruding portions 62*a*, and the pivot of the lid 20 is restricted. This prevents the lid 20 from being excessively opened relative to the body 30.

According to the embodiment of the present disclosure described above, it is possible to provide a figure-playable portable toy having the following aspects.

A figure-playable portable toy according to a first aspect includes: a body configured to be installed on an installation surface; a lid provided on the body via a first hinge so as to be allowed to open and close, the lid defining a storage space between the lid and the body; and a grip portion, in which the lid includes a contact portion that comes into contact with the installation surface in a state in which the lid is opened relative to the body such that the contact portion holds the lid which the lid is erected relative to the installation surface.

According to this configuration, when the body is installed on the installation surface and the lid is opened, the contact portion comes into contact with the installation surface in the state in which the lid is erected relative to the installation surface, and the lid is held. For this reason, the lid can be erected stably relative to the installation surface.

In the figure-playable portable toy according to a second aspect, the contact portion is provided as a part of a pivot base portion provided around the first hinge of the lid.

According to this configuration, the contact portion is provided in a vicinity of the first hinge of the lid, and thus the contact portion that holds the lid in an erected state relative to the installation surface can be specifically arranged.

The figure-playable portable toy according to a third aspect includes a second hinge having a second hinge shaft parallel to a first hinge shaft of the first hinge, in which the grip portion is pivotable on the lid via the second hinge, and the grip portion is allowed to pivot until coming into contact with the installation surface in a state in which the body is installed on the installation surface.

According to this configuration, the lid is supported by the grip portion relative to the installation surface by pivoting the grip portion until the grip portion comes into contact with the installation surface in the state in which the body is installed on the installation surface. Since the hinge shaft of the second hinge is parallel to the hinge shaft of the first hinge, the figure-playable portable toy can be prevented from falling down in a pivot direction of the lid by bringing the grip portion into contact with the installation surface in the state in which the lid is erected relative to the installation surface.

In the figure-playable portable toy according to a fourth aspect, the second hinge includes a protruding portion protruding in a direction substantially perpendicular to a hinge shaft direction of the second hinge, and the protruding portion restricts pivot of the lid by interfering with a part of the lid in the state in which the lid is opened relative to the body.

According to this configuration, the protruding portion restricts the pivot of the lid by interfering with the lid in the state in which the lid is opened, and thus the lid can be prevented from being excessively opened. For this reason, the lid can be erected further stably relative to the installation surface.

In the figure-playable portable toy according to a fifth aspect, the lid includes a plate-shaped member rotatably provided on the lid, the plate-shaped member being configured to protrude outward from an outer edge of the lid by rotating, and the body includes an engagement portion with which a part of the plate-shaped member is engaged in a state in which the lid is closed relative to the body.

According to this configuration, the plate-shaped member is engaged with the engagement portion in the state in which the lid is closed relative to the body, and thus the lid can be locked to the body. For this reason, when the figure-playable portable toy is carried in the state in which the lid is closed, the lid can be prevented or restricted from being opened by mistake due to an impact or the like.

The figure-playable portable toy according to a sixth aspect further includes a figure and a model toy, in which the storage space is configured to store at least one of the figure and the model toy, and the lid includes: a holding portion provided in the storage space and configured to hold the figure; and an opening through which the figure held by the holding portion is exposed.

According to this configuration, by arranging the model toy in a freely selected position in the state in which the lid is opened, the user can liken inner surface sides of the lid and the body to a store or the like and play with the figure, and can store the model toy in the storage space and carry the portable toy in a state in which the lid is closed. In addition, since the figure is held by the holding portion in the state in which the lid is closed and is exposed from the opening, the user can see and enjoy the figure even when carrying the figure-playable portable toy.

Although the embodiment of the present disclosure is described above, the present disclosure is not limited to the above embodiment, and various modifications can be made without departing from the gist thereof

What is claimed is:

1. A figure-playable portable toy comprising:

a body configured to be installed on an installation surface;

a lid provided on the body via a first hinge so as to be allowed to open and close, the lid defining a storage space between the lid and the body; and a grip portion, wherein the lid comprises a contact portion that comes into contact with the installation surface in a state in which the lid is opened relative to the body such that the contact portion holds the lid while the lid is erected relative to the installation surface, wherein the grip portion is pivotable on the lid via a second hinge, and the grip portion is allowed to pivot until coming into contact with the installation surface in a state in which the body is installed on the installation surface.

2. The figure-playable portable toy according to claim 1, wherein the contact portion is provided as a part of a pivot base portion provided around the first hinge of the lid.

3. The figure-playable portable toy according to claim 1, wherein the second hinge comprising a second hinge shaft parallel to a first hinge shaft of the first hinge.

4. The figure-playable portable toy according to claim 3, wherein the second hinge comprises a protruding portion protruding in a direction substantially perpendicular to a hinge shaft direction of the second hinge, and wherein the protruding portion restricts pivot of the lid by interfering with a part of the lid in the state in which the lid is opened relative to the body.

5. The figure-playable portable toy according to claim 1, wherein the lid comprises a plate-shaped member rotatably provided on the lid, the plate-shaped member being configured to protrude outward from an outer edge of the lid by rotating, and wherein the body comprises an engagement portion with which a part of the plate-shaped member is engaged in a state in which the lid is closed relative to the body.

6. The figure-playable portable toy according to claim 1, further comprising:

a figure and a model toy, wherein the storage space is configured to store at least one of the figure and the model toy, and wherein the lid comprises:

a holding portion provided in the storage space and configured to hold the figure; and an opening through which the figure held by the holding portion is exposed.

* * * * *